US009431229B2

(12) United States Patent
Yorisaki et al.

(10) Patent No.: US 9,431,229 B2
(45) Date of Patent: Aug. 30, 2016

(54) SPUTTER NEUTRAL PARTICLE MASS SPECTROMETRY APPARATUS WITH OPTICAL ELEMENT

(71) Applicant: KABUSHIKI KAISHA TOSHIBA, Minato-ku (JP)

(72) Inventors: Toma Yorisaki, Tokyo (JP); Reiko Saito, Yokohama (JP); Haruko Akutsu, Yokosuka (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/643,682

(22) Filed: Mar. 10, 2015

(65) Prior Publication Data

US 2015/0270113 A1 Sep. 24, 2015

(30) Foreign Application Priority Data

Mar. 18, 2014 (JP) ..... 2014-055418

(51) Int. Cl.
*H01J 49/14* (2006.01)
*H01J 49/16* (2006.01)
*H01J 49/04* (2006.01)

(52) U.S. Cl.
CPC ..... *H01J 49/161* (2013.01); *H01J 49/0409* (2013.01)

(58) Field of Classification Search
CPC .... H01J 49/161; H01J 49/162; H01J 49/164; H01J 49/10; H01J 49/0059; H01J 49/0463; H01J 49/142; H01J 2237/0815; H01J 27/24
USPC ..... 359/868, 869
See application file for complete search history.

(56) References Cited

U.S. PATENT DOCUMENTS 4,320,300 A * 3/1982 Mariella, Jr. ..... H01J 49/162 204/157.21
6,364,490 B1 * 4/2002 Krause ..... G03B 21/28 353/10

(Continued)

FOREIGN PATENT DOCUMENTS

JP 5-251035 9/1993
JP 2011-233248 11/2011

OTHER PUBLICATIONS

Yasuhiro Higashi, "Surface Analysis by Laser-Ionization Sputtered Neutral Mass Spectrometry", J. Vac. Soc. Jpn, vol. 44, No. 1, 2001, pp. 9-15.

(Continued)

*Primary Examiner* — Brooke Purinton
(74) *Attorney, Agent, or Firm* — Oblon, McClelland, Maier & Neustadt, L.L.P

(57) ABSTRACT

A sputter neutral particle mass spectrometry apparatus includes a sample table holding a sample which is a mass spectrometry target, an ion beam irradiation device which irradiates an ion beam on the sample held by the sample table to generate neutral particles in an adjacent region of the sample, a light beam irradiation device which irradiates a light beam on the neutral particles positioned in the adjacent region to obtain photoexcited ions, a draw-out electrode which draws out the photoexcited ions, a mass spectrometer which draws in the drawn out photoexcited ions to perform mass analysis, and an optical element which is provided in a light path after the light beam passes the adjacent region, and changes a traveling direction of the light beam so that the light beam passes the adjacent region again.

2 Claims, 3 Drawing Sheets

(56) References Cited

U.S. PATENT DOCUMENTS

| | | | | |
|---|---|---|---|---|
| 6,444,980 | B1 * | 9/2002 | Kawato | H01J 49/164 250/281 |
| 6,707,039 | B1 * | 3/2004 | Truche | H01J 49/164 250/282 |
| 2008/0131973 | A1 * | 6/2008 | Kirihara | H01J 49/162 436/139 |
| 2013/0118523 | A1 * | 5/2013 | Allison | H01J 49/164 250/423 P |

OTHER PUBLICATIONS

Tetsuya Maruo, et al., "Photoionization sputtered neutral mass spectrometry for depth profiling of semiconductors", Bunseki Kagaku, vol. 45, No. 1, 1996, pp. 31-40, with Partial English Translation.

Suguru Nishinomiya, et al., "Matrix effect-free depth profiling of implanted Mg in $Al_xGa_{1-x}As/GaAs$ multi-layers by resonance enhanced multiphoton laser post-ionization sputtered neutral mass spectrometry", Surface and Interface Analysis, vol. 44, 2012, pp. 641-643.

Shingo Ebata, et al., "Development of laser ionization mass nanoscope (LIMAS)", Surface and Interface Analysis, vol. 44, 2012, pp. 635-640.

Tetsuo Sakamoto, et al., "Selective detection of polyaromatic hydrocarbons on diesel exhaust particles using sputtered neutral mass spectrometry", Surface and Interface Analysis, vol. 45, 2013, pp. 1309-1312.

* cited by examiner

| | Comparative example | Present embodiment |
|---|---|---|
| Schematic diagram |   |   |
| Laser optical axis | Horizontal to sample surface 200μm above sample surface | For simplification, calculating only in vertical direction centering on a spot deviated 50μm from ion beam irradiation position |
| Number of particles included within laser irradiation region | 197 | 730 |

SPUTTER NEUTRAL PARTICLE MASS SPECTROMETRY APPARATUS WITH OPTICAL ELEMENT

CROSS-REFERENCE TO RELATED APPLICATION

This application is based upon and claims the benefit of priority from the prior Japanese Patent Application No. 2014-055418, filed Mar. 18, 2014, the entire contents of which are incorporated herein by reference.

FIELD

The embodiment of the present invention relates to a sputter neutral particle mass spectrometry apparatus.

BACKGROUND

In recent years, a sputter neutral particle mass spectrometry apparatus using a focused ion beam device and a light beam oscillation device has been developed. In light beam post-ionized neutral particle mass spectrometry using a focused ion beam, an ion beam is irradiated on a sample to generate neutral particles, and a light beam is made incident horizontally on the surface of the sample to perform post-ionization a single time. Here, a secondary ion mass spectrometry apparatus is equipped with a light beam for post-ionization to improve detection sensitivity. Therefore, the measuring system is simplified to facilitate optimization of the timing for irradiating the light beam and the timing for drawing in ions.

In such neutral particle mass spectrometry, since the output of the light beam is small, it has been necessary to make the light beams converge at a particular position on the sample surface in order to secure sufficient detection sensitivity. Therefore, to prevent background noise caused by direct contact of the light beams with the sample from occurring, the optical axis of the light beam has been required to be designed horizontal to, and at a fixed distance from the sample surface. As a result, the light beam irradiation timing needed to be delayed, and thus density per unit volume of a sputter neutral particle group decreased, causing a decline in yield.

In recent years, objects to be analyzed by the sputter neutral particle mass spectrometry apparatus have become microscopic. Therefore, there is a need for a sputter neutral particle mass spectrometry apparatus which is capable of improving detection sensitivity by increasing the yield of any element in the region of analysis.

DETAILED DESCRIPTION

A sputter neutral particle mass spectrometry apparatus according to one embodiment includes a sample table holding a sample which is a mass spectrometry target, an ion beam which is irradiated on the sample held by the sample table to generate neutral particles in an adjacent region of the sample, a light beam irradiation device which irradiates a light beam on the neutral particles positioned in the adjacent region to obtain photoexcited ions, a draw-out electrode which draws out the photoexcited ions, a mass spectrometer which draws in the drawn out photoexcited ions to perform mass analysis, and an optical element which is provided in a light path after the light beam passes the adjacent region, and changes a traveling direction of the light beam so that the light beam passes the adjacent region again.

Figure 1:
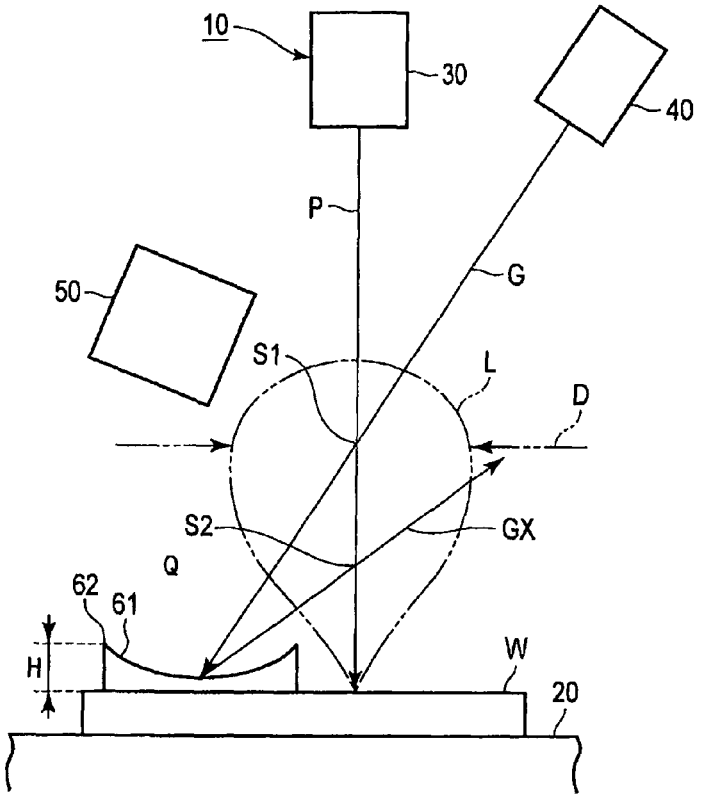
FIG. 1 is a schematic diagram showing a sputter neutral particle mass spectrometry apparatus according to a first embodiment.
Figure 2:
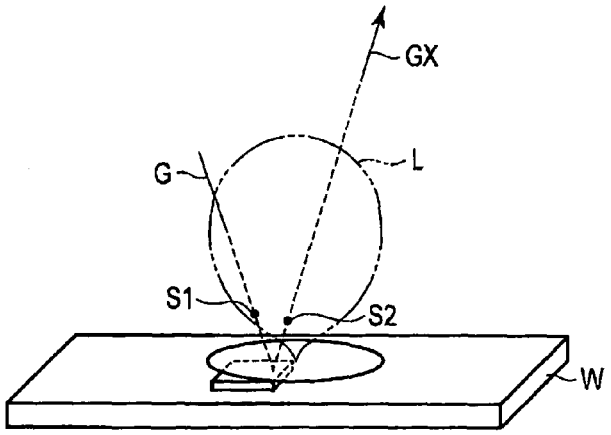
FIG. 2 is a diagram showing a mass spectrometry process of the sputter neutral particle mass spectrometry apparatus.
Figure 3:
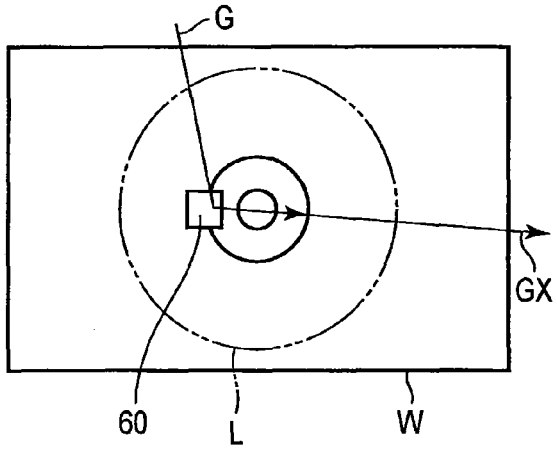
FIG. 3 is a diagram showing the mass spectrometry process observed from an ion beam irradiation direction.

FIG. 1 is a schematic diagram showing a sputter neutral particle mass spectrometry apparatus 10 according to a first embodiment, FIG. 2 is a diagram showing a mass spectrometry process of the sputter neutral particle mass spectrometry apparatus 10, and FIG. 3 is a diagram showing the mass spectrometry process observed from an ion beam irradiation direction.

The sputter neutral particle mass spectrometry apparatus 10 comprises: a sample table 20 which is accommodated in a vacuum chamber, etc. and holds a sample W which is to be analyzed; an ion beam irradiation device 30 which is arranged above the sample table 20 and irradiates an ion beam P on the sample W to generate neutral particles; a light beam irradiation device 40 which irradiates a light beam G on a proximity region Q directly above the sample table 20; a mass spectrometry apparatus 50 which is arranged near the proximity region Q and draws in the neutral particles to perform mass analysis; and a concave mirror (optical element) 60 placed on the sample W and which changes the traveling direction of the light beam G.

The concave mirror 60 is arranged at a position where the ion beam P is not irradiated directly, with a reflective surface 61 faced upwards. The highest periphery 62 of the concave mirror 60 is formed at a height H lower than where a diameter D of an adjacent region L explained later on is positioned.

The sputter neutral particle mass spectrometry apparatus 10 configured in the above manner performs mass analysis in the following manner. In other words, the ion beam irradiation device 30 generates the ion beam P and makes it collide against the surface of the sample W. This collision causes the neutral particles to discharge from the surface of the sample W and float in the adjacent region L which is directly above the sample table 20. The adjacent region L in which neutral particles with high density float is almost in the shape of a spindle, with a largest portion at the diameter D somewhat on the upper side of the height direction.

Meanwhile, the light beam G generated from the light beam irradiation device 40 is irradiated on the neutral particles floating within the adjacent region L. The neutral particles are ionized near the focal point of the light beam G to become photoexcited ions. Since light beam G is condensed (condensing spot S1) inside the adjacent region L, photon density is increased, which allows ionization of various elements simultaneously. The photoexcited ions are drawn out into the mass spectrometer 50, separated, and electrically pulsed for composition analysis of the sample W.

At this point, the light beam irradiation direction is positioned in a normal direction of the sample W, that is, so that the light beam is incident on the concave mirror 60 from a direction angled less than 90° with respect to the incident direction of the ion beam P, in a manner that the light path of the light beam G and the light path of the ion beam P intersect. This is to increase the detection sensitivity in a manner mentioned later on.

The light beam G is reflected by the reflective surface 61 of the concave mirror 60 and changes direction, to be re-irradiated toward the adjacent region L as light beam GX. Here as well, the non-ionized neutral particles are irradiated, and the composition analysis is conducted by the mass spectrometry apparatus 50 in the same manner. By using the concave mirror 60, the light beam G spread by passing the condensing spot can be converged (condensing spot S2) again within the adjacent region L. In this manner, the photon density is increased and various elements can be ionized simultaneously.

In the sputter neutral particle mass spectrometry apparatus 10 according to the present embodiment configured in the above manner, by passing the light beam G and the light beam GX through the adjacent region L, the opportunity of ionizing the neutral particles can be doubled. Therefore, even if the output of the light beam is small, sufficient detection sensitivity can be secured.

Since there is no need to irradiate the light beam in parallel with the sample, background noise caused by direct contact can be prevented from occurring.

Figure 4A:
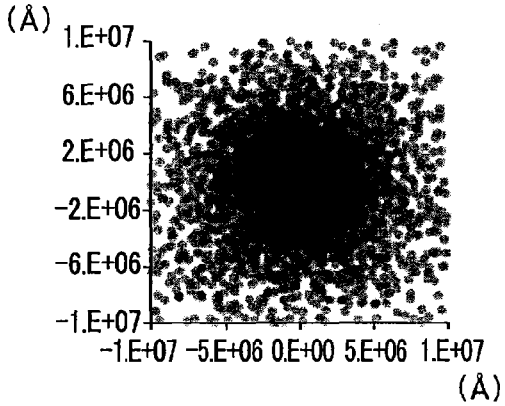
FIG. 4A is a diagram showing a density of a sputter neutral particle from above in a light beam irradiation direction (25°) of the sputter neutral particle mass spectrometry apparatus.
Figure 4B:
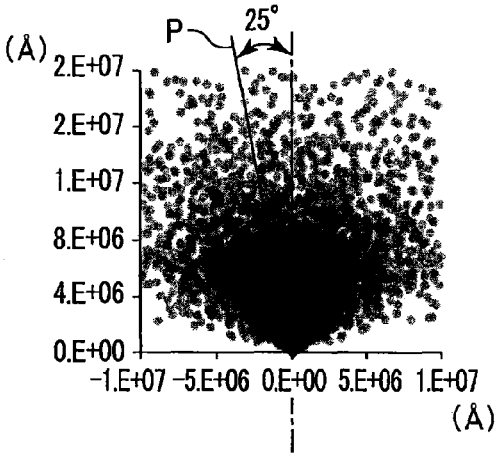
FIG. 4B is a diagram showing the density of the sputter neutral particle from the side in the light beam irradiation direction (25°) of the sputter neutral particle mass spectrometry apparatus.
Figure 5A:
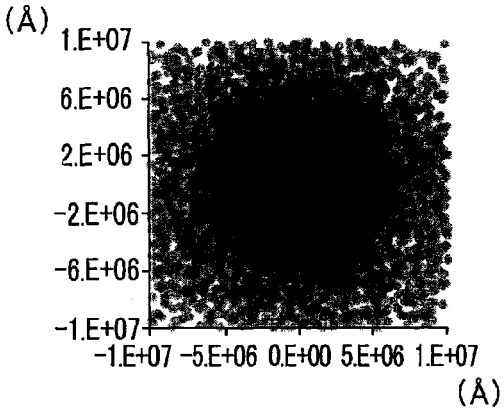
FIG. 5A is a diagram showing the density of the sputter neutral particle from above in a light beam irradiation direction (55°) of the sputter neutral particle mass spectrometry apparatus.
Figure 5B:
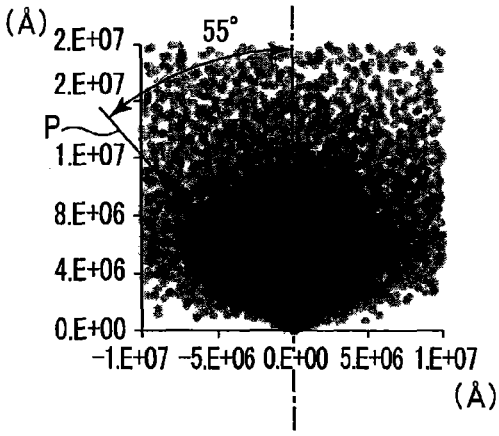
FIG. 5B is a diagram showing the density of the sputter neutral particle from above in the light beam irradiation direction (55°) of the sputter neutral particle mass spectrometry apparatus.

FIG. 4A is a diagram showing a density of a sputter neutral particle from above in a light beam irradiation direction (25°) of the sputter neutral particle mass spectrometry apparatus 10, FIG. 4B is a diagram showing a density of a sputter neutral particle from the side in a light beam irradiation direction (25°) of the sputter neutral particle mass spectrometry apparatus 10, FIG. 5A is a diagram showing a density of a sputter neutral particle from above in a light beam irradiation direction (55°) of the sputter neutral particle mass spectrometry apparatus 10, and FIG. 5B is a diagram showing a density of a sputter neutral particle from the side in a light beam irradiation direction (55°) of the sputter neutral particle mass spectrometry apparatus 10. This shows distribution after 100 nsec of initiating irradiation of a SRIM2013 30 keV, Ga beam.

As mentioned above, the sputter particle distribution obtained in the case where the ion beam irradiation is incident from directions angled 25° and 55° from the normal direction of the sample W surface is shown. As could be understood from the particle distributions, even if the incident direction of the ion beams is changed, the trend of the sputter neutral particle distribution remains almost unchanged.

Figure 6:
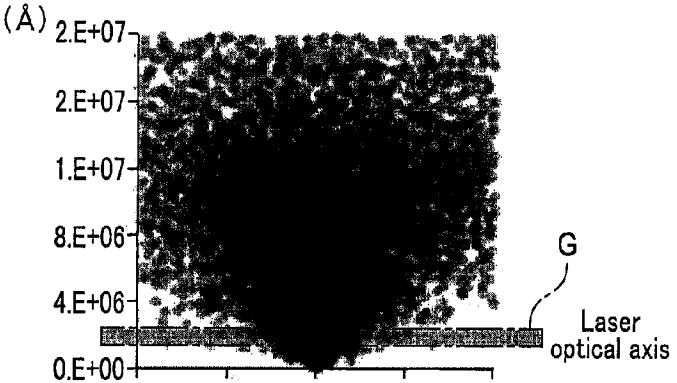
FIG. 6 is a diagram comparing an optical axis of a laser in a sputter neutral particle mass spectrometry of a comparative example and an optical axis in the present embodiment.
Figure 6:
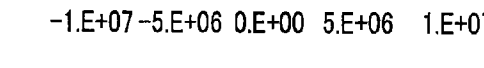

FIG. 6 is a diagram comparing the optical axis of a laser in a sputter neutral particle mass spectrometry of a comparative example and an optical axis in the present embodiment. It may be understood from the drawing that the number of particles included in a laser irradiation region according to the present embodiment has been increased from the number of sputter particles included in a laser irradiation region of the comparative example. The portion indicated as M in the present embodiment in FIG. 6 is a calculation range. In fact, when considering the reflected lasers as well, this will septuplicate, and increase even more if the laser is made to be reflected over a plurality of times. However, since this will be a trade off with mass resolution, the number of reflections should be controlled along with its purpose.

In the above-mentioned embodiment, the traveling direction is changed once, and the light beam passes the proximity region twice. However, it is also fine to change the traveling direction of the light beam at least twice to increase the effect of the neutral particles and the light beam to at least three times.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A sputter neutral particle mass spectrometry apparatus comprising:

a sample table holding a sample which is a mass spectrometry target;

an ion beam irradiation device which irradiates an ion beam on the sample held by the sample table to generate neutral particles in an adjacent region of the sample;

a light beam irradiation device which irradiates a light beam on the neutral particles positioned in the adjacent region to obtain photoexcited ions;

a draw-out electrode which draws out the photoexcited ions;

a mass spectrometer which draws in the drawn out photoexcited ions to perforin mass analysis; and an optical element which is provided in a light path after the light beam passes the adjacent region, and changes a traveling direction of the light beam so that the light beam passes the adjacent region again, wherein the light beam is incident on the optical element from a direction angled less than 90° with respect to a normal direction of a surface of the sample, a light path of the light beam and a light path of the ion beam intersecting.

2. A sputter neutral particle mass spectrometry apparatus comprising:

a sample table holding a sample which is a mass spectrometry target;

an ion beam irradiation device which irradiates an ion beam on the sample held by the sample table to generate neutral particles in an adjacent region of the sample;

a light beam irradiation device which irradiates a light beam on the neutral particles positioned in the adjacent region to obtain photoexcited ions;

a draw-out electrode which draws out the photoexcited ions;

a mass spectrometer which draws in the drawn out photoexcited ions to perform mass analysis; and an optical element which is provided in a light path after the light beam passes the adjacent region, and changes a traveling direction of the light beam so that the light beam passes the adjacent region again, wherein the optical element is a concave mirror, and wherein the concave mirror is placed on a surface of the sample, and a height from the sample surface to top of the concave mirror is set lower than a position in the adjacent region where a group of the neutral particles becomes widest in a direction parallel to the surface of the sample.

* * * * *